United States Patent [19]

Wieder

[11] Patent Number: 4,745,871

[45] Date of Patent: May 24, 1988

[54] METHOD AND APPARATUS FOR COVERING AND CONTAINING A SAIL

[76] Inventor: Edwin F. Wieder, 15 Jane's La., Lloyd Harbor, Huntington, N.Y. 11743

[21] Appl. No.: 12,825

[22] Filed: Feb. 10, 1987

Related U.S. Application Data

[63] Continuation-in-part of Ser. No. 845,599, Mar. 28, 1986, abandoned.

[51] Int. Cl.[4] ..... B63H 9/10

[52] U.S. Cl. ..... 114/102; 114/105

[58] Field of Search ..... 114/102, 103, 104, 105, 114/106, 108, 39

[56] References Cited

U.S. PATENT DOCUMENTS

| | | | |
|---|---|---|---|
| 2,499,598 | 3/1950 | Maurer et al. | 114/103 |
| 4,354,444 | 10/1982 | Puretic | 114/104 |
| 4,474,127 | 10/1984 | Stevenson, IV | 114/104 |

FOREIGN PATENT DOCUMENTS

| | | | |
|---|---|---|---|
| 14137 | of 1907 | United Kingdom | 114/104 |

*Primary Examiner*—Joseph F. Peters, Jr.
*Assistant Examiner*—Edwin L. Swinehart
*Attorney, Agent, or Firm*—Collard, Roe & Galgano

[57] ABSTRACT

A sail cover apparatus and method for completely covering a sail that is slidably supported on the mast and boom of a sailboat wherein a pair of elongated flexible cover halves are provided having mating lower edges for detachable securement along the foot of the sail, and upper edges for closure over the sail. The lower edges of the cover halves are secured adjacent to the foot of the sail disposed along the boom. The cover halves are raised and lowered by lift lines secured adjacent to the sail on both sides along its full length and substantially parallel to both sides of the sail. Thus, a sail receiving pocket is formed, permitting the sail to be lowered into the space between the sail cover halves. The upper edges of said cover halves are closed to encircle the sail after the sail has been lowered. The cover is thus collapsed and compacted around the enclosed sail.

20 Claims, 6 Drawing Sheets

12
68
60
13a
67
16a
37
36
14a
9a
15a
110a
24
126
59
56
58
130
21
128
129
119
6
55
54
65

15a
55
18
119
54
57
59
126
56
110a
128
58

METHOD AND APPARATUS FOR COVERING AND CONTAINING A SAIL

This is a continuation-in-part of application Ser. No. 845,599 filed Mar. 28, 1986, now abandoned.

BACKGROUND OF THE INVENTION

This invention relates to an improved mainsail or mizzensail cover and method that can quickly cover or uncover the mainsail of a sailboat.

More specifically, this invention relates to a sail cover and method of operation for the mainsail of a boat that is connected to the foot of the sail along the boom and, with the aid of lift lines, can be quickly utilized to cover or uncover the sail.

In the design of pleasure sailboats, the mainsail is normally supported by the main mast and has its luff or leading edge connected to a track along the mast. The foot of the mainsail is usually connected to the boom by means of a series of sliding slugs which run the length of the foot, and fits into a correspondingly shaped slot formed along the top edge of the boom. When not in use, sails such as mainsails should be stored in covers in order to prevent the sun's ultraviolet rays from gradually destroying the fabric. Conventional covers commonly in use are generally made of canvas or acrylic material, and are wrapped around the sail and the boom by using lacing cords and/or snap fittings after the mainsail has been gathered and lashed to the boom. On larger boats, installation of the cover, after the mainsail has been used, can take a number of minutes and can become a difficult task, especially in high winds or rough sea conditions. In larger boats, and where the crew is limited, the installation of the sail cover can tie up at least one crew member for five to ten minutes who otherwise might be needed for other tasks. Moreover, it is important to quickly gather the mainsail once it has been lowered onto the boom, since the mainsail can also block the view of the helmsman at a time when the boat may be navigating into a narrow harbor or through an anchorage with closely spaced together boats.

In order to quickly gather the mainsail after use, some designers have created furling mainsails with hardware not very dissimilar from that of a vertical window shade. Here, the mainsail is released from the end of the boom and furled onto a roller which is pivotably disposed parallel to the trailing edge of the main mast. In another device, the vertical furling mechanism has been installed inside of the main mast so that through the use of gears and pulleys, the sail can be pulled through a vertical, elongated slot on the trailing edge of the main mast, and be completely stored inside the hollow mast extrusion. A more recent prior art device for containing and bagging a mainsail consists of making the lower portion of the mainsail a part of the sail cover so that when the sail is lowered on the boom, its lower portion separates into two panels and permits the upper portion to be gathered between the two lower panels. A similar system called the "Zip Stop" gathers the main vertically along the mast and zips the two panels closed. This is described in U.S. Pat. No. 4,343,257. Other devices are disclosed in U.S. Pat. Nos. 3,611,969 to Hood; 3,851,609 to Stearn; 3,964,419 to Uecker; 3,980,036 to Crall; and 4,034,694 to Dismukes.

In the patent to Puretic, U.S. Pat. No. 4,354,444, there is disclosed generally triangular panels secured along the boom and a portion of the mast above the boom. The panels are designed to straddle the boom and define an open topped sail receiving pocket. This device, however, stays in its fully raised position on the boom and the mast, and cannot be collapsed out of the way when the sail is raised, nor can it be lifted back into position when the sail is to be dropped, since it does not provide for any lifting lines. In the patent to Achterberg, U.S. Pat. No. 639,916, a rigid basket or pocket is formed on both sides of the sail above the boom so that when the sail is dropped into the pocket, the basket halves can be hinged closed over the sail.

All of the above prior art methods of gathering the mainsail suffer from the disadvantage in that they are either expensive, involve complicated and unreliable hardware which is subject to exposure to open sea conditions, cannot be collapsed, distort the shape of the sail, and therefore impair the windflow across the mainsail.

SUMMARY OF THE INVENTION

Accordingly the present invention provides an improved sail cover which does not significantly alter the construction of the mainsail but is merely attached on each side of the foot of the mainsail along the boom. With the use of "lazy" jack or lift lines, the novel cover can be easily deployed to enclose the mainsail when the sail is not in use, or can be easily lowered, collapsed, and compacted, to allow the mainsail to be hoisted into place, and to allow the cover to be stowed out of the way of sailing activity.

The improved cover according to the present invention can also be adapted to existing mainsails with minor changes to the lines connected to the boom and mast. The improved cover of the present invention can be deployed by one person in a minimum amount of time so that the mainsail can be completely gathered and stowed away within the cover with no interference with the helmsman's forward vision.

It is therefore an object according to the present invention to provide an improved sail cover which can be easily deployed around the mainsail of a boat with a minimum amount of effort.

It is another object according to the present invention to provide an improved mainsail cover which is simple in design, efficient in operation, and inexpensive in cost.

Other objects and features of the present invention will become apparent from the following detailed description considered in connection with the accompanying drawings which disclose the embodiments of the invention.

BRIEF DESCRIPTION OF THE DRAWINGS

In the drawings, wherein similar reference characters denote similar elements throughout the several views.

DETAILED DESCRIPTION OF THE INVENTION

Referring now in detail to the appended drawings, there is shown a conventional sailboat having installed along its boom the inventive cover 10 or 110 wherein boom 11 has its free end supported from the mast by topping lift 61. A series of lazy jack or lift lines 13*a*, 13*b* support further lift lines 16*a*, 16*b* which in turn support further lift lines 14*a*, 14*b*, 15*a*, 15*b* and 9*a*, 9*b*, having their free ends coupled to cover 10.

Figure 3:
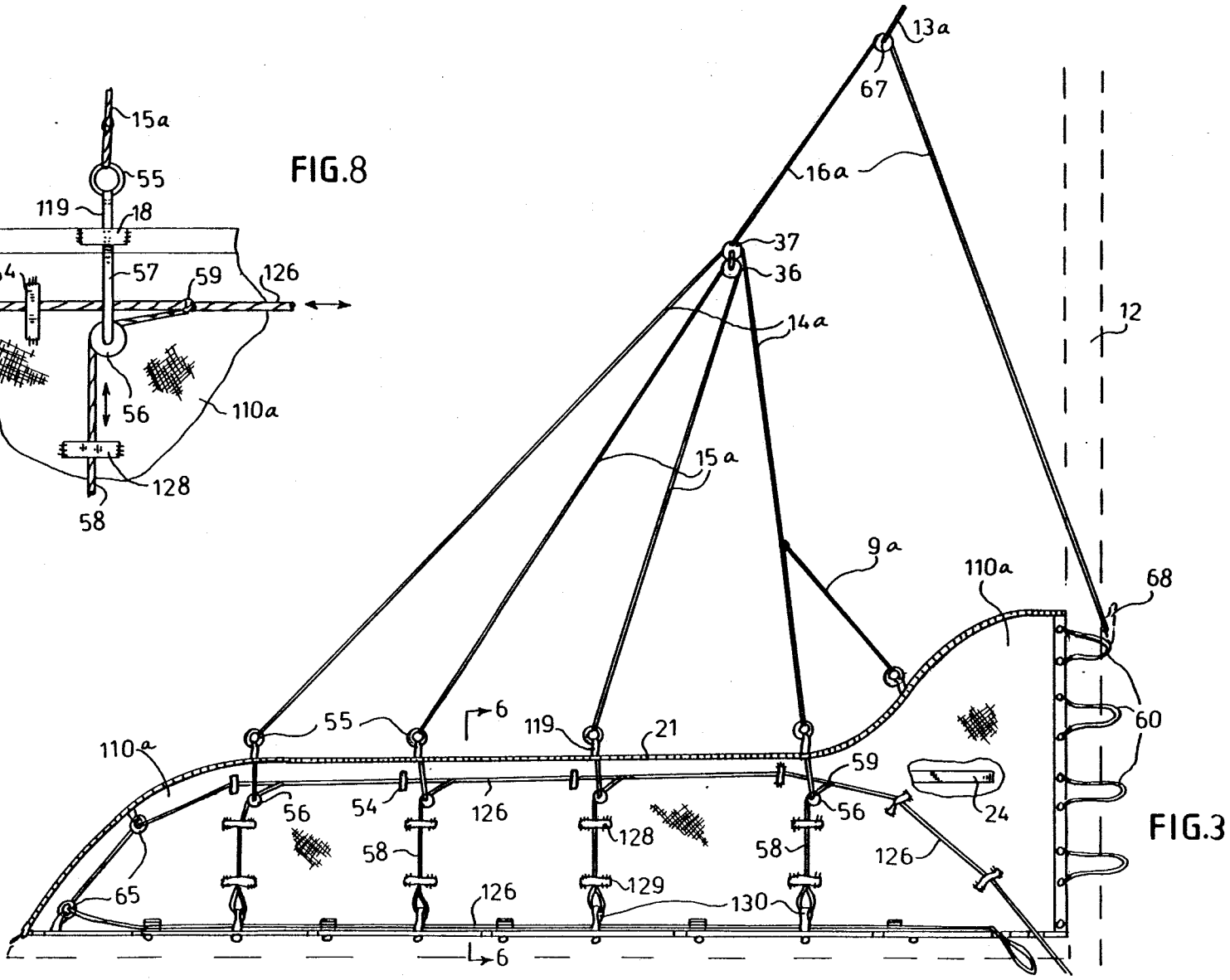
FIG. 3 is a perspective view partly in cross section of the cover according to the invention raised to receive and cover the sail.

Referring to FIG. 3, there is shown cover half 110*a* in its raised position supported on boom 11 and mast 12 by means of lift lines 9*a*, 14*a*, 15*a* and 16*a*. Lift line 13*a*, which has one end connected to the top of the mast, terminates in block or sheave 67 which supports lift line 16*a*. Line 16*a* has one end cleated to mast 12 by means of cleat 68. The other end of lift line 16*a* terminates in block 37 which supports lift line 14*a*. Block 37 also supports a second block 36 which carries lift line 15*a* coupled to O-rings 55 connected by means of stitched tapes to cover half 110*a*. In each cover half 110*a* or 110*b*, a batten 24 serves as a longitudinal stiffening element to keep the cover half rigid. The batten is preferably sewn into the side of the cover and is generally out of sight. Cover half 110 is provided with a plurality of belt loops 54 which serve to guide line 126 along the upper periphery of the cover adjacent to its closure element 21. Another set of vertical belt loops 128 and 129 serve to guide vertical lines 58 from their connection at the bottom edge of cover 110 on boom 11 through blocks 56 to their other connection 59 on line 126.

Figure 8:
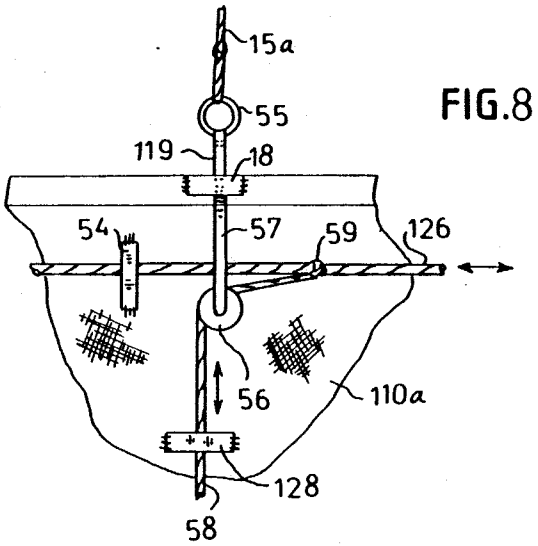
FIG. 8 is a detailed view of a portion of the cover of FIG. 3.

As shown in detail in FIG. 8, line 58 may be connected by means of a knot or splice to line 126. The number of vertical lines 58 which are connected to line 126 will obviously depend upon the size of the cover and the length of the boom. Each of the blocks or sheaves 56 which support lines 58 are connected by means of lines 57 to the top edge of cover half 110*a* immediately below supporting tape 119 which is stitched near the top edge of cover 110*a* by means of tab 18. Thus, in this embodiment, each of the vertical lines 58 is associated with a lift line which couples to cover half 110*a* above the vertical line in order to facilitate the collapse and opening of the cover according to the invention.

Figure 4:
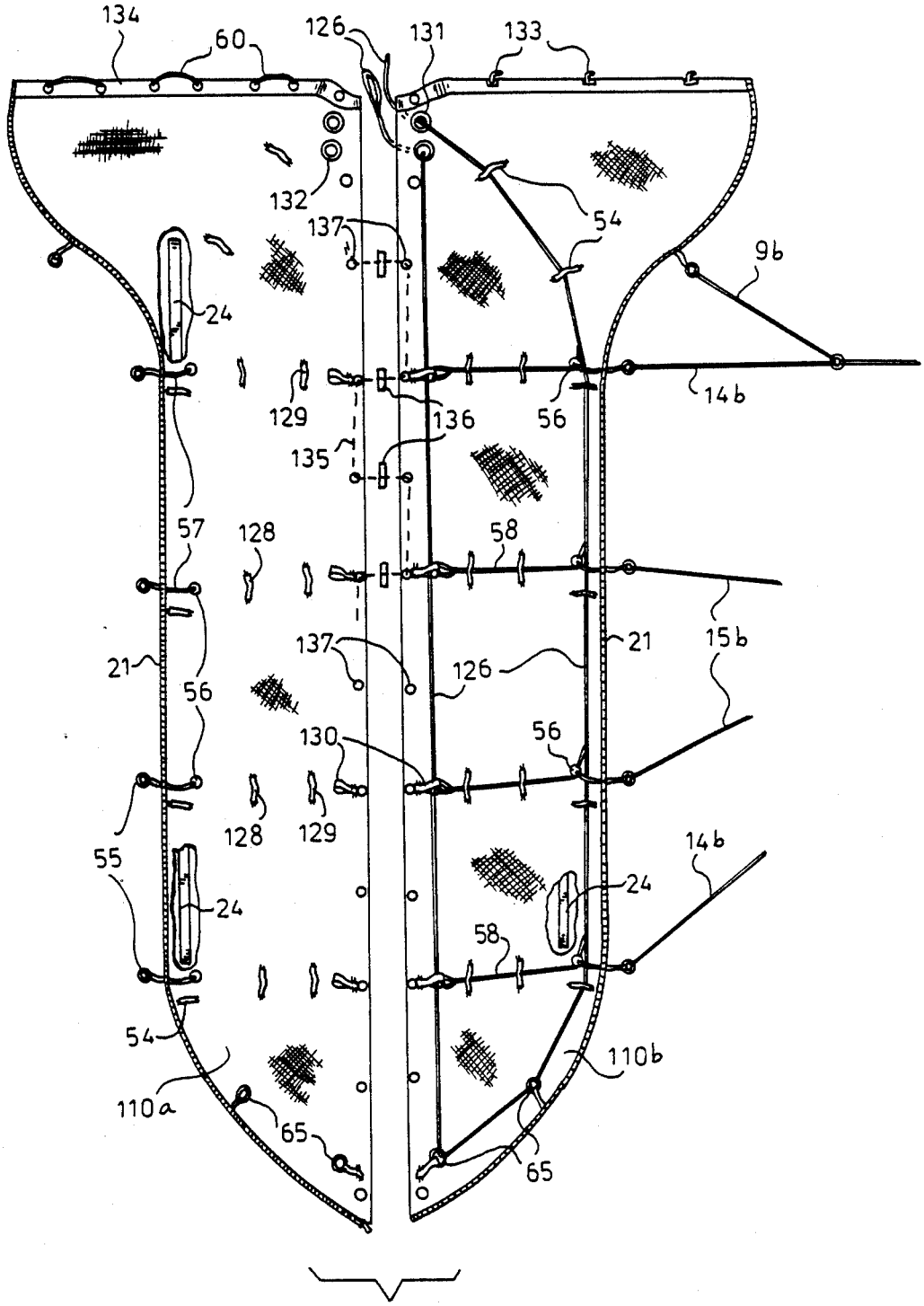
FIG. 4 is a detailed view partly in cross section of one embodiment of the cover halves of the invention.

Line 126 which is used not only to collapse the cover but also to allow it to be raised around the sail, passes not only through belt loops 54, but also through O-rings 65 and lower belt loops 130, and exits out through grommets 131 and 132 as shown also in FIG. 4.

Figure 6:
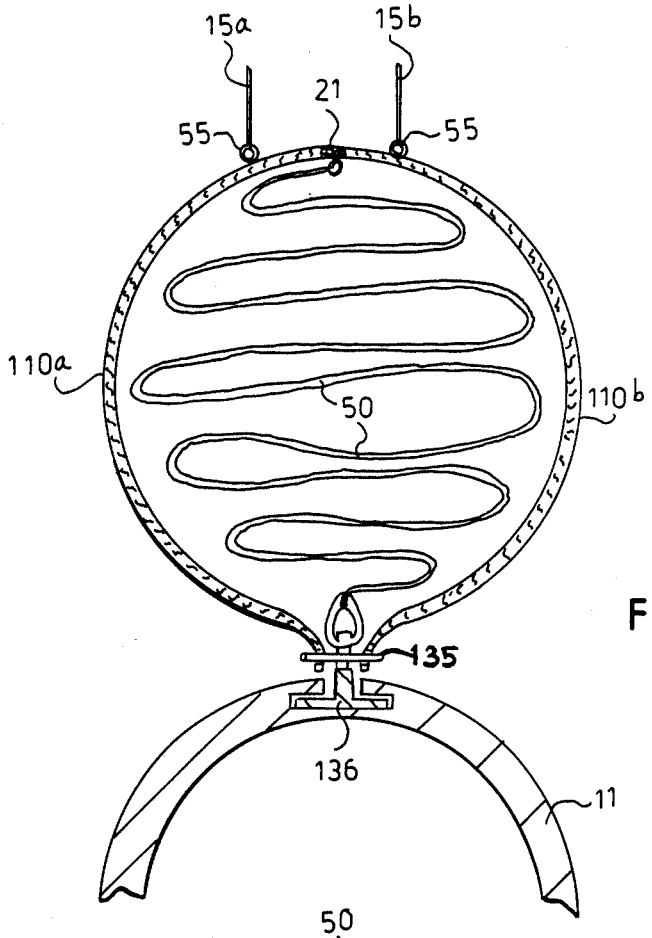
FIG. 6 is a cross-sectional view taken along section 6—6 of FIG. 3.

In FIG. 4, both cover halves 110*a* and 110*b* are shown opened before they are attached to the boom. Along the leading edge of the cover is a lacing cord 60 which passes through grommet holes along the leading tape 134 of the cover. Loops 60 will connect to individual hooks 133 after the loops are passed around the body of mast 12. Since the cover according to the present invention can be adapted to fit most booms without the necessity of having to purchase a new mainsail, the cover can be connected to the boom by means of a lacing line 135, as shown in dotted line in FIG. 4, passing alternately between grommet openings 137 along the bottom tape of each of covers 110*a* and 110*b*, and also passing through mainsail track clips 136. Clips 136 are contained along the foot of the sail, and fit in a recess slot along the leading edge of boom 11 (see also FIGS. 6 and 7). In this manner, cover halves 110*a* and 110*b* can be easily secured to the boom using track sliders 136 along the foot of the mainsail, without having to cut, drill, or stitch additional fastening elements to the sail or to the boom.

Figure 7:
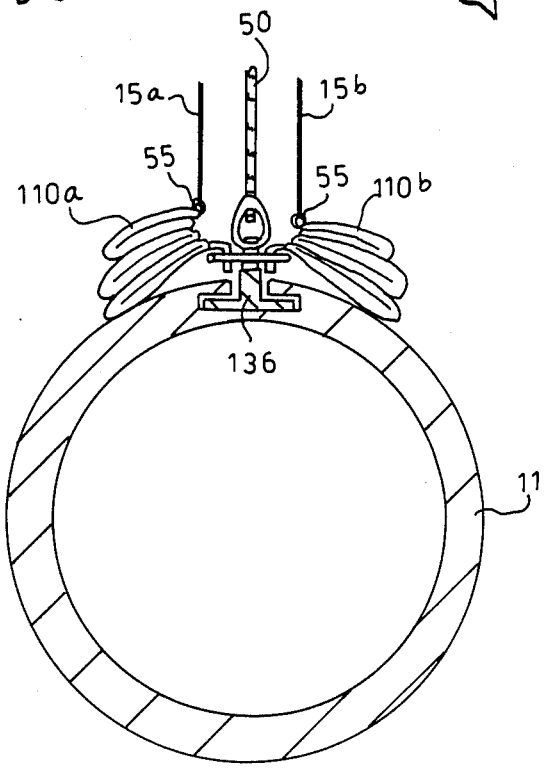
FIG. 7 is a cross-sectional view taken along section 7—7 of FIG. 2.

Cover halves 110*a* and 110*b* are maintained closed around the sail by means of a fastening edge 21 which could be the mating halves of a nylon slide fastener or zipper, or the mating halves of Velcro. Obviously, hooks or other fastening devices could also be used. In order to hoist the mainsail when the cover is closed, the mating surfaces of fastening element 21 are separated either by pulling on the slide fastener's tab or separating the Velcro halves. Mainsail 50 is then hoisted by means of its own halyard to the top of the mast. In the meantime, lift lines 16*a* and 16*b* are released from cleat 68, as shown in detail in FIG. 2. The release of lift lines 16*a* and 16*b* slacken lift lines 14*a* and 14*b*, 15*a* and 15*b*, and 9*a* and 9*b*, and allow the cover to be lowered and pleated on both sides of the boom. Line 126 can then be tightened to maintain the cover halves snugly against boom 11. Lacing lines 60 can be loosened or released from hooks 133 to permit the cover to slide down the lower surface of mast 12. After the cover has been collapsed, it will lay on both sides of the boom in a compressed and pleated condition, as shown in FIG. 7. This stores or stows the cover halves securely on the boom at the foot of the sail to be out of the way of sailing activity. Both cover halves 110*a* and 110*b* are symmetrical and mirror images of one another so that for simplicity, lines 58 and 126 have been left off cover half 110*a*, as shown in FIG. 4.

Figure 5:
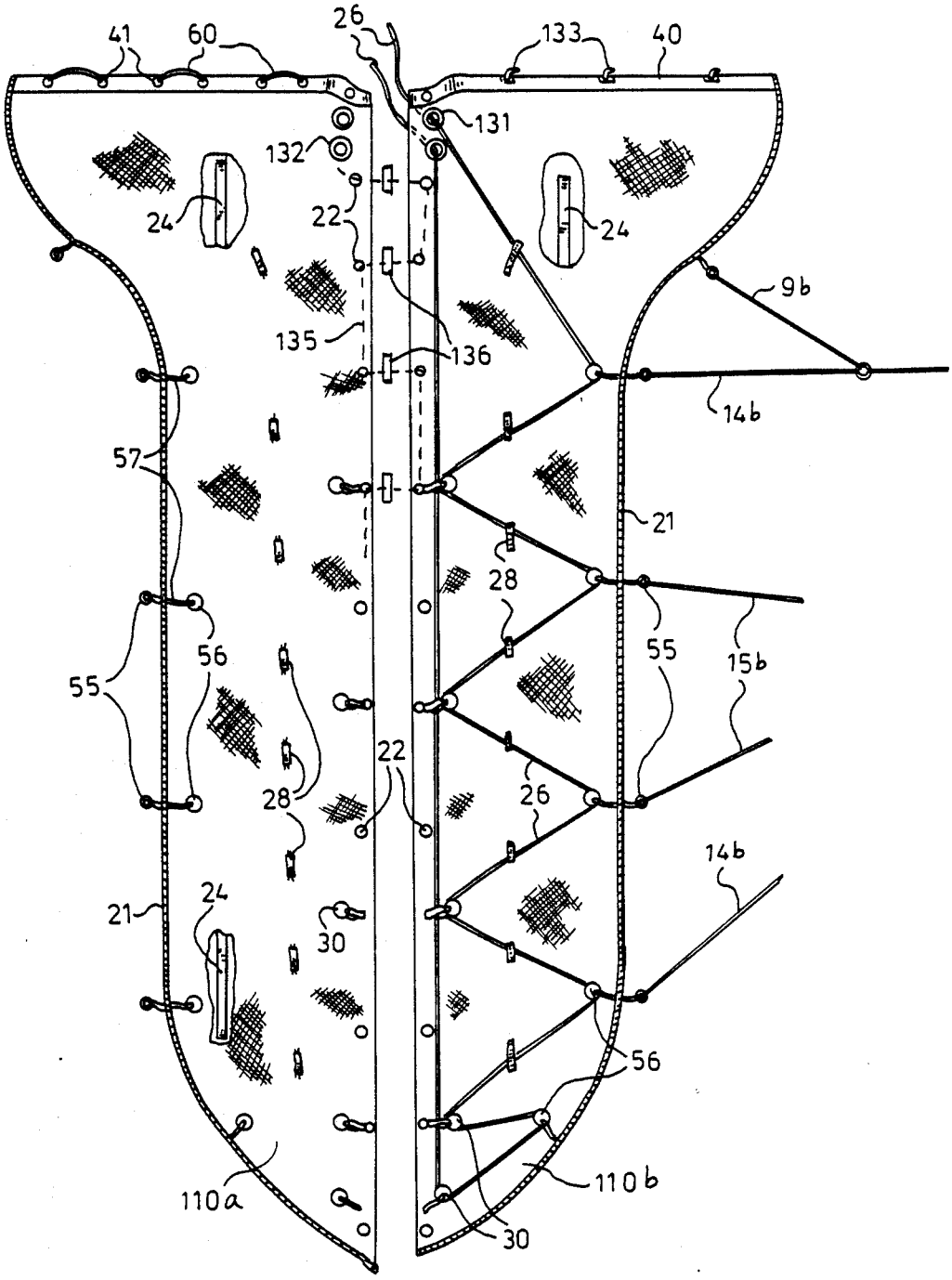
FIG. 5 is a detailed view partly in cross section of another embodiment of the cover halves of the invention.

As an alternate embodiment to vertical control lines 58 coupled to line 126, it is also possible to provide a zig-zag tensioning line, as shown in the second embodiment of the invention in FIG. 5. In FIG. 5, line 26 passes through belt loops 28 in a zig-zag manner. Blocks 56 which are maintained below each of the lift lines 14*a* and 15*a*, support the top half of zig-zag line 26. Belt loops 28 allow line 26 to pass through to blocks 30. In a manner similar to the embodiment of FIGS. 2 and 3, this zig-zag embodiment can also be collapsed by pulling on line 26 after lift lines 16*a* and 16*b* are released. Likewise, the bottom tape of cover halves 10*a* and 10*b* of the embodiment of FIG. 5 can also be coupled to the foot of the mainsail using lacing line 135 passed through mainsail track sliders 136, lacing line 135 being coupled through grommet openings 22.

When cover 10 or 110 is to be used to completely cover mainsail 50, the cover halves should first be raised by the lift lines to allow the mainsail to drop in between the cover halves. To raise the cover halves, stow lines 26 or 126 should be released, and line 60 should be slackened. In a preferred embodiment of the invention, the mainsail is preferably fully battened by means of battens 51 so that the sail will physically accordion pleat itself when it is lowered. Thus, when lines 26 or 126 are released and lift lines 16*a* and 16*b* are pulled into place lifting cover halves of cover 10 or 110 to its highest position above boom 11, the cover halves and raised lift lines will guide and capture the mainsail 50 as it flakes and accordion pleats itself on top of the boom. After fastening element 21 has been closed so as to contain the sail within the cover as shown in detail in FIG. 6, lines 26 or 126 can then be pulled to tighten the cover halves around the folded sail to prevent any movement of the cover or the contained sails.

In order to raise the mainsail, lines 26 or 126 are released in order to release the tension on both halves of the sail cover. Moreover, pull string 60 is also slackened or released to release tension on the front edges of the cover halves. Then, zipper or slide fastener halves 21 are separated by pulling on its slider, from the front to the aft of the cover. The main halyard which is already connected to the cringle at the top of main 50 is pulled downward to raise the mainsail to its full height. Then, adjustable lift lines 16*a* and 16*b* are slackened to lower lift lines 14*a* and 14*b*, and 15*a* and 15*b*. Then, tension is applied to line 26 or 126 in order to collapse and store the cover halves tightly against the foot of the main on top of the boom. Finally, pull string 60 is tensioned in order to prevent the front edges of the sail cover halves from slapping freely.

Figure 1:
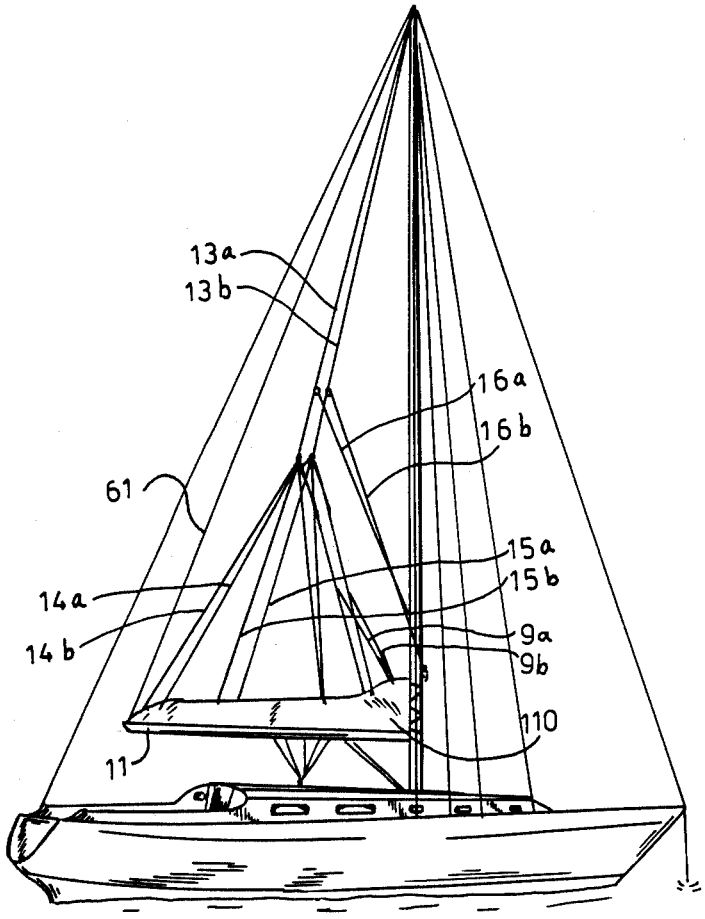
FIG. 1 is a perspective view of a sailboat equipped with the improved mainsail cover according to the invention.
Figure 2:
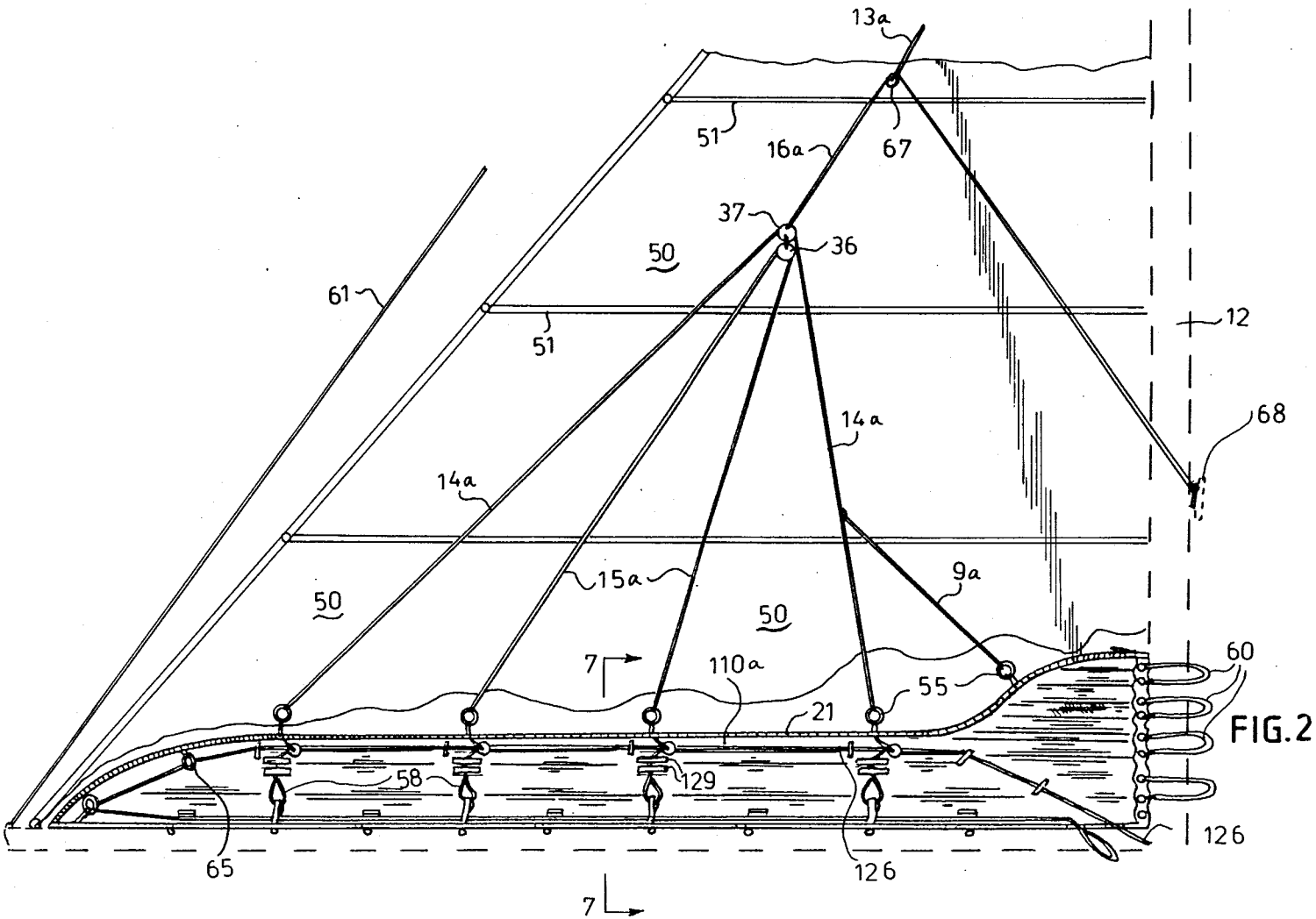
FIG. 2 is a perspective view slightly in cross section showing the sails raised and the cover of the invention in a collapsed and stowed state.

In an actual embodiment of the invention, the sail cover should be constructed of material that is ultraviolet resistant such as acrylic, treated canvas, or dacron. The lift lines and pull cords should be constructed of dacron or nylon for long life and durability. The zipper consisting of halves 20 and 21 and tab 9 should be constructed of nylon so as to be rust and corrosion resistant. The O-ring pairs are preferably constructed of nylon, Delrin or stainless steel, and the grammets should be constructed of corrosion resistant material such as nylon, Delrin or brass. The stiffening elements or battens 24, located in pockets 25 on each side of the halves 10A and 10B of the sail bag, are preferably constructed of flexible fiberglass or plastic. In order to facilitate a uniform gathering of the pleats within the improved sail bag of the invention, sail 50 should be provided with full length battens 51 as shown in FIG. 2. Conventional short roach batten sails presently existing can also be used as is or retrofitted with several full length battens.

The cover halves of the present invention are advantageous over prior art covers in that they can be easily removed from the sail by either unlacing the bottom of the cover halves, or in the case of zippers, unzipping the seams from the sail so that the sail and/or the cover can be either replaced, repaired, or cleaned.

The front of the cover could also be closed using string shock cord and hooks, lacing strings or Velcro. The cover could also be used on Freedom-type sailboats where a bow is used instead of a boom to hold down the foot of the sail. The cover could also be used for a mizzensail or with any sail that is attached at its foot to a boom.

If the foot of the sail is attached to a boom by means of a bead fitting into a boom slot, a thin elongated fabric tape could be provided to fit within the slot of the boom as the foot the sail is threaded into the slot so that the edges of the tape would be disposed external to the boom slot running along the exposed foot of the sail. Secured to each exposed edge of the tape could also be the mating teeth of a slide fastener or zipper that could connect to corresponding mating teeth provided along the bottom seams of each cover half. In this embodiment, there would be no need to provide grommets along the foot of the sail and the cover halves could be easily attached to the foot of the sail without the need of modifying the sail.

The sail can also be fitted with a line of grommets along its foot to receive and secure the lower cover halves. The cover could also be constructed of a single piece, instead of two halves, having its bottom slotted to receive the mainsail track sliders. Thus, the bottom of the cover replaces the bottom mating edges.

While only a single embodiment of the invention has been shown and described, it will be obvious that many changes and modifications may be made thereunto, without departing from the spirit and scope of the invention.

What is claimed is:

1. A sail cover apparatus for completely covering a sail that is slidably supported on the mast and boom of a sailboat comprising:

a pair of elongated flexible cover halves defining the sail cover and having mating lower edges for detachable securement along the foot of the sail, and upper edges for closure over the sail;

means for securing the lower edges of the cover halves adjacent to the foot of the sail disposed along the boom;

a lift line system comprising a plurality of first lines disposed on each side of said sail having their lower ends coupled adjacent to the top edges of said sail cover halves, at least one second line disposed on each side of said sail and coupled to said first lines for raising and lowering said cover halves adjacent to the sail on both sides along its full length and substantially parallel to both sides of the sail to form a sail receiving pocket to permit the sail to be lowered into the space between the sail cover havles;

means for closing the upper edges of said cover halves to encircle the sail after the sail has been lowered; and means for collapsing and compacting said cover halves around said enclosed sail when the sail is lowered and for collapsing and compacting said cover halves along the foot of the sail when the sail is raised.

2. The sail cover apparatus as recited in claim 1, comprising a third pair of lines each having one end slidably supporting each of said second lines, and opposite ends for coupling to said mast so that said at least a second pair of lines can be raised and lowered by lowering and raising each of the opposite ends of said third pair of lines.

3. The sail cover apparatus as recited in claim 1, wherein said means for closing the upper edges of said cover halves comprises a full length zipper having mating zipper teeth disposed along the top edges of each of said sail cover halves, and a zipper slider joining said mating teeth for closing the halves after the sail has been lowered.

4. The sail cover apparatus as recited in claim 1, additionally comprising a longitudinal pocket disposed along the length of each of said cover halves, and at least one batten disposed in said pocket.

5. The sail cover apparatus as recited in claim 1, wherein said means for collapsing and compacting said cover halves comprises a pull cord slideably secured in a zig zag pattern along each side of said cover halves between upper and lower edges to permit the cover halves to be gathered around the sail after said cover halves have been closed around the sail, and alternatively to permit the cover halves to be compacted on the boom when the sail has been hoisted.

6. The sail cover apparatus as recited in claim 1, wherein said means for collapsing and compacting said cover halves comprises a pull cord slidably disposed around the periphery of each cover half, a plurality of substantially parallel, spaced apart cords each secured to the lower edge and coupled to said pull cord adjacent to the upper edge, so that tensioning said pull cord of each cover half tensions said parallel cords so as to pull together said upper and lower edges to permit the cover halves to be gathered around the sail after said cover halves have been closed, and alternatively to permit the cover halves to be compacted on the boom when the sail has been hoisted.

7. The sail cover apparatus as recited in claim 1, wherein said means for closing said cover halves comprises means for closing the front end of said cover.

8. The sail cover apparatus as recited in claim 7, wherein said means for closing the front of the cover comprises a plurality of spaced apart hooks disposed along the front edges of said cover halves adjacent said mast, and a line for disposal through said hooks to secure said cover halves to said mast.

9. The sail cover apparatus as recited in claim 1, wherein said means for securing the bottom edges of said sail cover along the foot of said sail comprise a plurality of spaced apart grommets disposed along the bottom mating edges of said cover halves, correspondingly spaced apart grommets disposed along the foot of said sail, and means for lacing said bottom seam grommets of said sail cover halves to the sail grommets.

10. The sail cover apparatus as recited in claim 1, wherein said means for securing the bottom edges of said sail cover along the foot of said sail comprise a plurality of spaced apart grommets disposed along the bottom mating edqes of said cover halves, and lacing cord for coupling said grommets adjacent to the foot of said sail.

11. A method for completely covering a sail that is slidably supported on the mast and boom of a sailboat comprising the steps of:

providing a pair of elongated flexible cover halves having upper edges for closure over the sail, and lower edges, said cover halves defining a sail cover;

detachably securing the lower edges along the foot of the sail disposed along the boom;

providing a lift line system comprising a plurality of first lines disposed on each side of said sail having their lower ends coupled adjacent to the top edges of said sail cover halves, at least one second line disposed on each side of said sail and coupled to said first line means for raising and lowering said cover halves adjacent to the sail on both sides along its full length and substantially parallel to both sides of the sail to form a sail receiving pocket to permit the sail to be lowered into the space between the sail cover halves;

closing the upper edges of said cover halves to encircle the sail after the sail has been lowered; and collapsing and compacting said cover halves around said enclosed sail, when the sail is lowered, and collapsing and compacting the cover halves along the foot of the sail when the sail is raised.

12. The method as recited in claim 11, wherein said step of collapsing comprises inserting tension cords within each cover half coupling the upper and lower edges together so that tensioning said cords collapses said cover halves.

13. The method as recited in claim 11, comprising a third pair of lines each having one end slidably supporting each of said second lines, and opposite ends for coupling to said mast so that said second lines can be raised and lowered by lowering and raising each of the opposite ends of said third pair of lines.

14. The method as recited in claim 11, wherein the step of closing the upper edges of said cover halves comprises providing a full length zipper having mating zipper teeth disposed along the top edges of each of said sail cover halves, and further providing a zipper slider joining said mating teeth for closing the halves after the sail has been lowered.

15. The method as recited in claim 11, wherein said step of collapsing and compacting said cover halves comprises providing a pull cord slideably secured in a zig zag pattern along each side of said cover halves between upper and lower edges to permit the cover halves to be gathered around the sail after said cover halves have been closed around the sail, and alternatively permitting the cover halves to be compacted on the boom when the sail has been hoisted.

16. The method as recited in claim 11, wherein said step of collapsing and compacting said cover halves comprises providing a pull cord slidably disposed around the periphery of each cover half, providing a plurality of substantially parallel, spaced apart cords each secured to the lower edge and coupled to said pull cord adjacent to the upper edge, tensioning said pull cord of each cover half tensions said parallel cords so as to pull together said upper and lower edges to permit the cover halves to be gathered around the sail after said cover halves have been closed, and alternatively compacting the cover halves on the boom when the sail has been hoisted.

17. The method as recited in claim 11, wherein said step of closing said cover halves includes the step of closing the front end of said cover.

18. The method as recited in claim 17, wherein said step of closing the front of the cover comprises providing a plurality of spaced apart hooks disposed along the front edges of said cover halves adjacent said mast, and providing a line coupled along said edge for disposal through said hooks to secure said cover halves to said mast.

19. The method as recited in claim 11, wherein said step of securing the bottom edges of said sail cover along the foot of said sail comprises providing a plurality of spaced apart grommets along the bottom mating edges of said cover halves, providing correspondingly spaced apart grommets along the foot of said sail, and lacing said bottom edge gommets of said sail cover halves to the sail grommets.

20. The method as recited in claim 11, wherein said step of securing the bottom edges of said sail cover along the foot of said sail comprises locating a plurality of spaced apart grommets along the bottom mating edges of said cover halves, and lacing a cord to couple said grommets adjacent to the foot of said sail.

* * * * *